US011421388B1

(12) United States Patent
Henry et al.

(10) Patent No.: US 11,421,388 B1
(45) Date of Patent: Aug. 23, 2022

(54) SINGLE-WALLED DISPOSABLE COOLER MADE OF FIBER-BASED MATERIAL AND METHOD OF MAKING A SINGLE-WALLED DISPOSABLE COOLER MADE OF FIBER-BASED MATERIAL

(71) Applicant: Henry Molded Products Inc., Lebanon, PA (US)

(72) Inventors: Douglass C. Henry, Lebanon, PA (US); Robert S. Russell, Doylestown, PA (US)

(73) Assignee: Henry Molded Products, Inc., Lebanon, PA (US)

( * ) Notice: Subject to any disclaimer, the term of this patent is extended or adjusted under 35 U.S.C. 154(b) by 20 days.

(21) Appl. No.: 16/671,984

(22) Filed: Nov. 1, 2019

(51) Int. Cl.

| | |
|---|---|
| ***D21J 1/20*** | (2006.01) |
| ***D21J 5/00*** | (2006.01) |
| ***B65D 51/24*** | (2006.01) |
| ***B65D 25/28*** | (2006.01) |
| ***B65D 81/18*** | (2006.01) |
| ***D21H 17/60*** | (2006.01) |

(Continued)

(52) U.S. Cl.
CPC ..... *D21J 1/20* (2013.01); *B65D 25/2885* (2013.01); *B65D 51/242* (2013.01); *B65D 81/18* (2013.01); *D21H 11/14* (2013.01); *D21H 17/60* (2013.01); *D21J 5/00* (2013.01); *F25D 3/08* (2013.01)

(58) Field of Classification Search
CPC ... D21J 1/20; D21J 5/00; D21H 11/14; D21H 17/60; B65D 25/2885; B65D 51/242; B65D 81/18; F25D 3/08
See application file for complete search history.

(56) References Cited

U.S. PATENT DOCUMENTS 2,377,864 A 6/1945 Chaplin
2,424,189 A * 7/1947 Randall ..... D21J 3/00 249/113

(Continued)

FOREIGN PATENT DOCUMENTS

EP 3212525 B1 9/2017
WO WO-2016101976 A1 * 6/2016 ..... D21J 3/00

OTHER PUBLICATIONS

Hydrophobic properties of cardboard coated with polylactic acid and ethylene scavengers, Journal of Coatings Technology and Research, Sep. 2013, vol. 10, Issue 5, pp. 749-755, first online Apr. 5, 2013, 11 pages.

(Continued)

*Primary Examiner* — Jose A Fortuna
(74) *Attorney, Agent, or Firm* — Barley Snyder

(57) ABSTRACT

A single-walled disposable cooler is provided and generally includes a body and a lid. The body is generally made from a pulp-based material or fiber-based material and includes a base and a plurality of support walls coupled to the base. At least one of the plurality of support walls includes a substantially planar surface. The plurality of support walls and the base define an interior cavity of the body, while the plurality of support walls extend upwardly from the base to form an opening at an upper terminus of the body in fluid communication with the interior cavity. The lid is also made from the pulp-based material or fiber-based material and corresponds with the body. The lid is shaped to cover the opening of the body.

6 Claims, 11 Drawing Sheets

(51) Int. Cl.
*F25D 3/08* (2006.01)
*D21H 11/14* (2006.01)

(56) References Cited

U.S. PATENT DOCUMENTS 2,600,265 A * 6/1952 Randall ..... D21J 3/00 249/113
2,961,043 A 11/1960 Hicks
3,161,705 A * 12/1964 Kindseth ..... D21J 5/00 264/510
3,205,128 A * 9/1965 Brafford ..... D21J 7/00 162/401
3,284,284 A * 11/1966 Wells ..... D21J 5/00 162/218
3,317,371 A * 5/1967 Alsman ..... D21J 5/00 162/385
3,325,349 A * 6/1967 Reifers ..... B65D 85/324 162/228
4,337,116 A * 6/1982 Foster ..... B29C 51/162 156/212
5,399,243 A * 3/1995 Miyamoto ..... D21J 7/00 162/199
5,603,808 A * 2/1997 Nishikawa ..... D21J 7/00 162/382
5,745,971 A 5/1998 Ohsawa et al.
6,083,447 A 7/2000 Turner
6,164,526 A 12/2000 Dalvey
6,210,531 B1 * 4/2001 Bradford ..... B29C 43/56 162/218
6,361,659 B1 * 3/2002 Yang ..... B27N 5/00 162/382
6,576,089 B1 * 6/2003 Sato ..... D21J 3/10 162/227
6,582,562 B2 * 6/2003 Gale ..... D21J 7/00 162/382
6,592,720 B1 7/2003 Nonomura
6,605,187 B1 8/2003 Nonomura et al.
6,752,910 B2 * 6/2004 Sato ..... D21J 3/10 162/396
6,857,199 B2 2/2005 Otani et al.
6,860,461 B1 * 3/2005 Otani ..... D21J 7/00 162/382
6,899,793 B2 5/2005 Nonomura et al.
7,008,509 B1 * 3/2006 Otani ..... D21J 3/10 162/218
7,067,041 B2 6/2006 Tsuura et al.
7,582,190 B2 9/2009 Salm
7,909,964 B2 * 3/2011 Nilsson ..... D21J 7/00 162/226
8,246,784 B2 * 8/2012 Nilsson ..... D21J 3/00 162/226
8,795,474 B2 * 8/2014 Lang ..... D21J 3/00 162/382
9,663,898 B2 * 5/2017 Zhang ..... D21J 3/00
9,856,608 B1 * 1/2018 Chung ..... D21J 5/00
9,932,710 B2 * 4/2018 Kuo ..... D21J 3/00
9,976,262 B2 * 5/2018 Kuo ..... D21J 3/00
9,988,767 B2 6/2018 Gumbert
10,087,584 B2 * 10/2018 Chung ..... B65D 85/70
10,113,271 B2 * 10/2018 Gordon ..... D21J 3/00
10,309,062 B2 * 6/2019 Halvardsson ..... D21J 5/00
10,377,547 B2 * 8/2019 Chung ..... B30B 7/00
10,428,467 B2 * 10/2019 Chung ..... B65D 25/14
10,435,848 B2 * 10/2019 Andersson ..... B22F 5/007
10,676,872 B2 * 6/2020 Chen ..... D21J 3/10
10,683,611 B2 * 6/2020 Chung ..... D21B 1/16
10,711,404 B2 * 7/2020 Sundblad ..... D21J 3/00
10,766,685 B2 9/2020 Kuhn et al.
10,767,313 B2 * 9/2020 Kuo ..... D21H 27/10
10,801,164 B2 * 10/2020 Andersson ..... B22F 3/1109
11,053,051 B2 * 7/2021 Kuo ..... D21J 3/02
2005/0150624 A1 7/2005 Toh et al.
2007/0034346 A1 2/2007 Salm
2009/0283235 A1 11/2009 Salm
2013/0112694 A1 5/2013 Bentley
2013/0216797 A1 8/2013 Lerch et al.
2018/0141718 A1 5/2018 Ahlstrom et al.
2018/0155878 A1 6/2018 Gumbert

OTHER PUBLICATIONS

PCT International Search Report and the Written Opinion, dated Apr. 16, 2021, 14 pages.

* cited by examiner

SINGLE-WALLED DISPOSABLE COOLER MADE OF FIBER-BASED MATERIAL AND METHOD OF MAKING A SINGLE-WALLED DISPOSABLE COOLER MADE OF FIBER-BASED MATERIAL

FIELD OF INVENTION

The present disclosure relates to a single-walled cooler made of a pulp-based material or fiber-based material that is suitable for the storage and transportation of items, including food, drink, medicine, and temperature sensitive materials; and the method of manufacture of the pulp-based single-walled cooler.

BACKGROUND

Coolers, ice chests, ice boxes, or the like are well known for the storage of contents (e.g., food, beverages, medicines etc.) intended to be kept cool, relative to ambient temperature. Typically, the cooler or ice box is filled with a cooling material, such as ice or reusable freezer packs, and placed in proximity to the contents to be kept cool. While many coolers are constructed using durable materials intended for repeated use, the conventional plastic coolers tend to be expensive and bulky, consequently other coolers have been manufactured to be disposable, that typically are less expensive. Coolers of the disposable variety are conventionally made from expanded polystyrene foam (i.e., Styrofoam®).

Polystyrene is a non-biodegradable solid that is resistant to chemicals and material break down. Disposal of polystyrene coolers, consequently, can cause significant environmental harm as discarded polystyrene will persist in the environment for centuries. Many cities and counties across the United States have passed regulations banning sale of polystyrene products for this reason. Thus, there exists a need for a disposable cooler, that is less expensive to manufacture, and provides the benefit of being capable of being composted, bio-degraded, or recycled sustainably and effectively.

SUMMARY

A single-walled disposable cooler is provided and generally includes a body and a lid. The body is generally made from a pulp-based material or fiber-based material and includes a base and a plurality of support walls coupled to the base. At least one of the plurality of support walls includes a substantially planar surface. The plurality of support walls and the base define an interior cavity of the body, while the plurality of support walls extend upwardly from the base to form an opening at an upper terminus of the body in fluid communication with the interior cavity. The lid is also made from the pulp-based material or fiber-based material and corresponds with the body. The lid is shaped to cover the opening of the body.

In accordance with an exemplary embodiment of the present disclosure, a single-walled, pulp-based, disposable cooler can include: a body and optionally, a lid, where the body includes a base and a plurality of support walls coupled to the base. The plurality of support walls and the base defining an interior cavity of the body, and the plurality of support walls extend upwardly from the base to form an opening at an upper terminus of the body in fluid communication with the interior cavity; and a lid configured to reversibly couple with the body, the lid shaped to cover the opening of the body, and to form a seal around the perimeter of the lid, serving to preserve the contents within the body, and form part of a thermal barrier to maintain the temperature of the contents within the body. The body can be made entirely of a pulp-based material or fiber-based material. In an embodiment, at least one of the plurality of support walls includes a substantially planar surface, wherein the surface does not feature any ribs, grooves, flutings or channels, but rather may present a slightly convex profile, by having a slight outward bow to the otherwise flat surface, as will be discussed. In another embodiment, one or more of the plurality of support walls includes a surface provided with distinct surface features that provide additional rigidity and strength to the support wall, such as incorporating one or more of ribs, columnar grooves, flutings, vertical channels or corrugations.

The lid of the cooler may be formed so as to fit inside of upper ends of the plurality of support walls. In this embodiment, the plurality of support walls can be formed with a ledge disposed beneath the upper ends of the plurality of support walls, the ledge being substantially parallel with the base, and the lid can be formed such that outer edges thereof rest on the ledge when the lid covers or is placed into the opening of the body. Additionally, the lid may be formed with a handle portion, typically disposed at a central region thereof, whereby the user may grasp the handle to facilitate removal of the lid from the opening in which the lid had been resting.

The body can be formed with a handle portion disposed at an upper region of the body.

The lid can be formed with one or more cup holders disposed on a top portion thereof:

The lid can be made entirely of the pulp-based material, or alternatively made of a non-pulp-based material, such as fiber-based material.

The pulp-based material may be derived from recycled paper. Also, the pulp-based material can be made with a combination of recycled paper and wax. The pulp-based material or fiber-based material may include a wax additive, or other hydrophobic treatment, that will repel water penetration into and/or through the formed pulp material.

The pulp-based material or fiber-based material can be compostable, recyclable, and/or biodegradable.

Furthermore, In accordance with an exemplary embodiment of the present disclosure, a method for manufacturing a single-walled disposable cooler can include: forming, using a pulp-based material or fiber-based material, a body including a base and a plurality of support walls coupled to the base, such that at least one of the plurality of support walls includes a substantially planar surface, the plurality of support walls and the base define an interior cavity of the body, and the plurality of support walls extend upwardly from the base to form an opening at an upper region of the body in fluid communication with the interior cavity; and forming a lid configured to reversibly couple with the body, such that the lid is shaped to cover the opening of the body.

Furthermore, in accordance with an exemplary embodiment described herein, the method of manufacturing a single walled disposable cooler can include: providing a slurry composition of wood pulp fibers, a die form having a die body, a screen, a vacuum mechanism, and a pressure mechanism, inserting the die form into the slurry and applying vacuum through the die form to draw slurry and fibers against the die form exterior and create a molded layer having a first shape conforming to the die form, and removing the die form from the slurry, delivering a pressurized charge of gaseous fluid to through the die form, whereupon the molded layer has a second shape, and removing the molded layer from the die form. The molded layer may further be dried.

Furthermore, in accordance with an exemplary embodiment of the present disclosure, a cooler can include: a single-walled disposable shell made entirely of a pulp-based material or fiber-based material, the shell including: a body including a base and a plurality of support walls coupled to the base, the plurality of support walls and the base defining an interior cavity of the body, and the plurality of support walls extend upwardly from the base to form an opening at an upper region of the body in fluid communication with the interior cavity; and a lid configured to reversibly couple with the body, the lid shaped to cover the opening of the body. The lid can be formed so as to fit inside of the upper ends of the plurality of support walls, and optionally formed with one or more cup holders disposed on a top portion thereof. In an embodiment, at least one of the plurality of support walls provides a substantially planar surface. In another embodiment, at least one of the plurality of support walls provides one or more of vertical fluting or ribs that provide additional stiffness to the support wall.

BRIEF DESCRIPTION OF THE DRAWINGS

The embodiment herein may be better understood by referring to the following description in conjunction with the accompanying drawings in which like reference numerals indicate identically or functionally similar elements, of which.

Figure 1A:
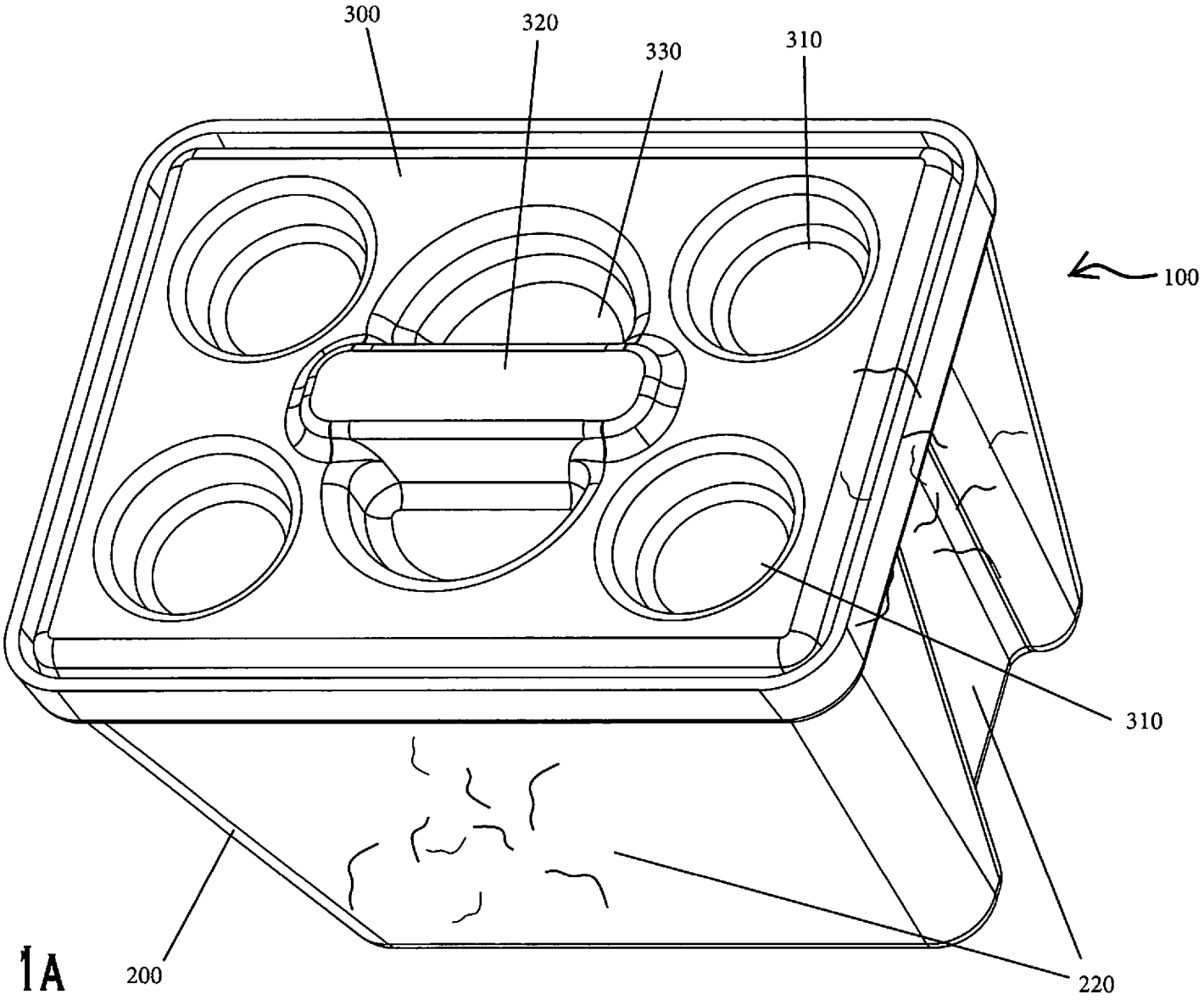
FIG. 1A is a perspective view of a single-walled disposable cooler according to an exemplary embodiment of the invention.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENT(S)

Hereinafter, an exemplary embodiment of the present disclosure will be described in detail with reference to the accompanying drawings. As those skilled in the art would realize, the described embodiment may be modified in various different ways, all without departing from the spirit or scope of the present disclosure. Further, throughout the specification, like reference numerals refer to like elements.

The terminology used herein is for the purpose of describing a particular exemplary embodiment only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to an exemplary embodiment of the present disclosure, the single-walled disposable cooler 100 discussed herein can be made of a pulp-based material or fiber-based material. The pulp-based material or fiber-based material is compostable, recyclable, and/or biodegradable, such that the cooler 100 can be disposed of in an environmentally friendly manner as the pulp-based material or fiber-based material from which the cooler 100 is manufactured is capable of composting, or biodegrading rapidly relative to conventional polystyrene coolers; and furthermore, the pulp-based material or fiber-based material does not result in the release or production of toxic residues as it is composted, bio-degraded or recycled.

The accompanying figures illustrate an exemplary embodiment of the disclosed single-walled disposable cooler 100. As described in detail herein below, FIGS. 1A-1F include views of a single-walled disposable cooler 100 according to an exemplary embodiment of the present disclosure; and FIGS. 2A-2B include top views of a cross-section of a single-walled disposable cooler 100 according of the present disclosure at different stages of manufacture. FIGS. 3A-C include views of the forming die 500 useful for the manufacture of the body 200 of the exemplary embodiment of the present disclosure.

It is understood that the aforementioned exemplary embodiment and features associated therewith are not mutually exclusive of each other. Any of the features shown to be associated with an embodiment described herein may be adopted in another embodiment described herein. Therefore, the description herein of the exemplary embodiment does not imply that any features associated with a particular embodiment are limited solely to said embodiment.

Figure 1B:
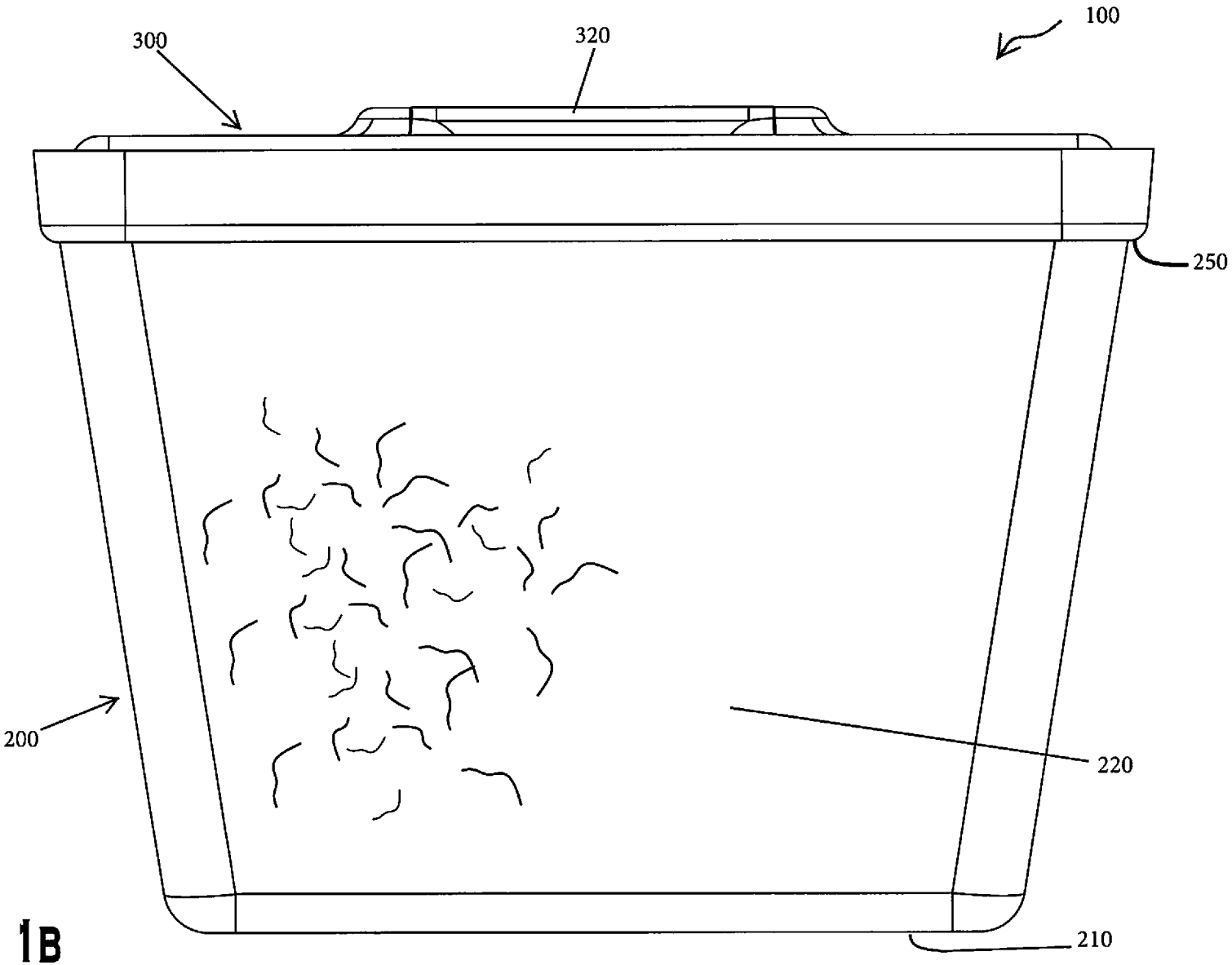
FIG. 1B is a front view of the single-walled disposable cooler of FIG. 1A.
Figure 1C:
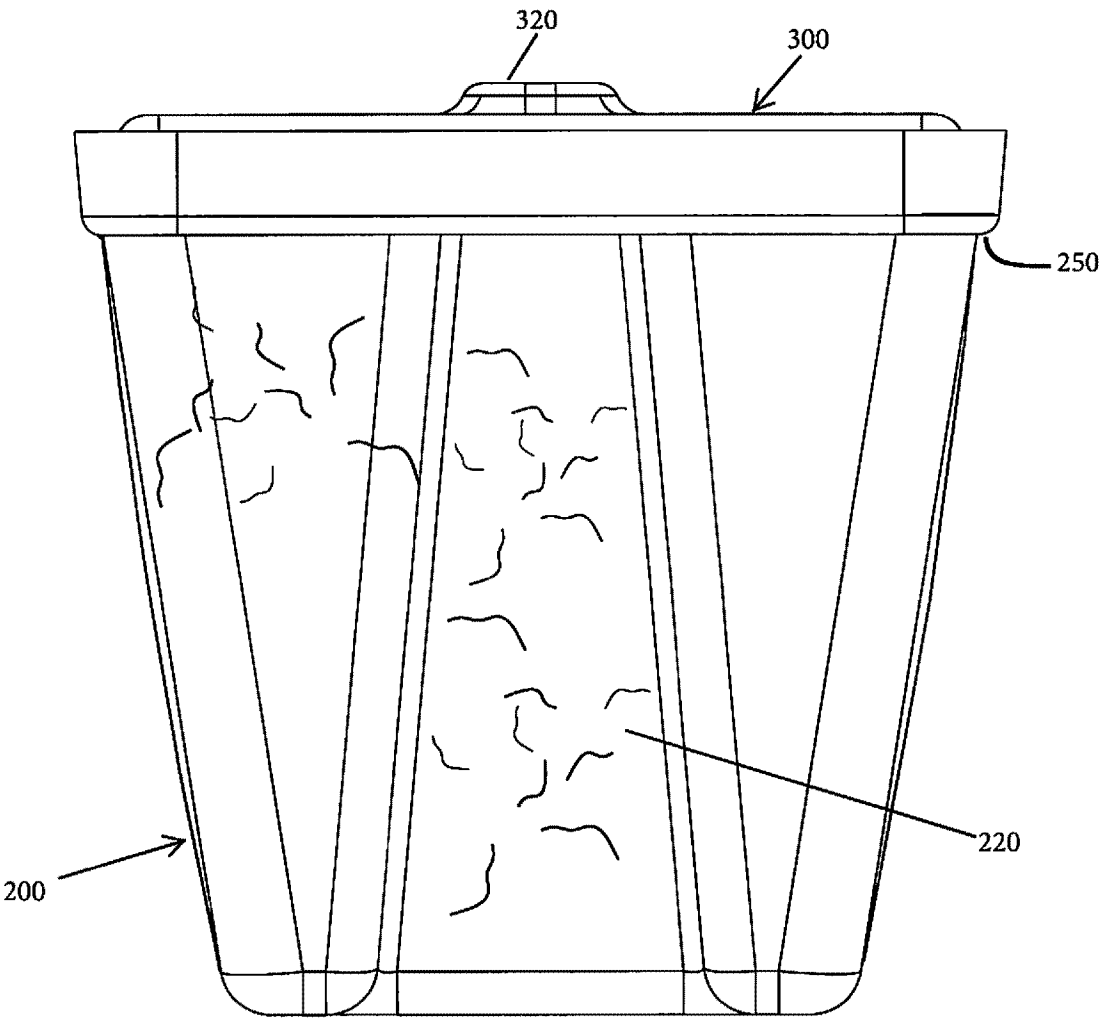
FIG. 1C is a side view of the single-walled disposable cooler of FIG. 1A.
Figure 1D:
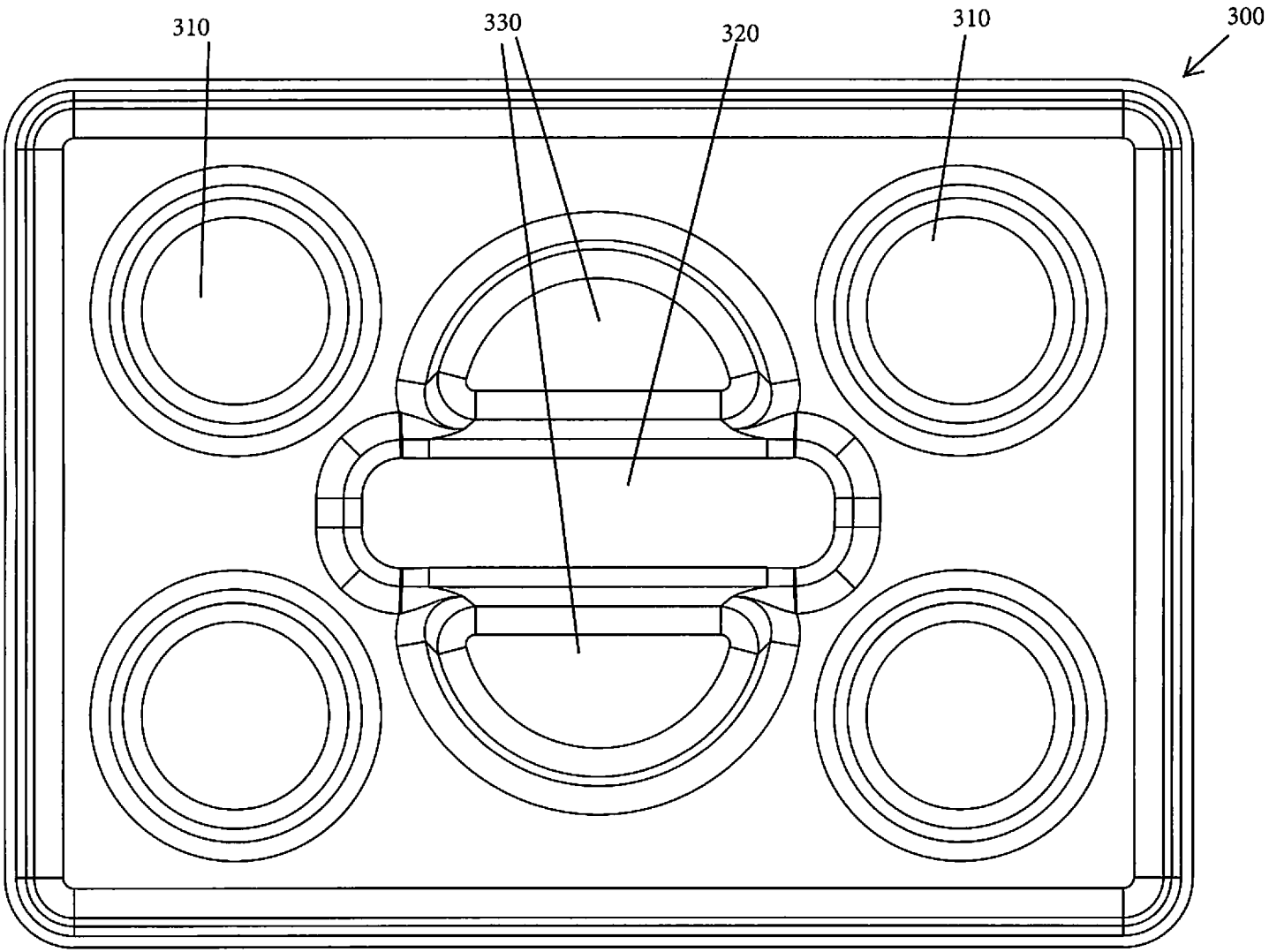
FIG. 1D is a top view of a lid for the single-walled disposable cooler of FIG. 1A.

As illustrated in the figures, an exemplary embodiment of the single-walled disposable cooler 100 (hereinafter "cooler 100") 100 may include a single-walled disposable shell, made through a pulp-based molding process using a pulp-based material or fiber-based material, and defining a body 200. The body 200 can include a base 210 and a plurality of support walls 220 coupled to the base 210. In an embodiment, the body 200 is substantially rectangular when viewed from above or below, albeit having an overall taper in the height dimension, where the base 210 is of smaller dimensions than the top of the body 200. In the embodiment shown in FIG. 1, there are two longer support walls 220 on opposite sides, and two shorter support walls 220 on opposite sides, generally perpendicular to the longer support walls 220. It is contemplated that the cooler 100 may have 4 support walls 220 of similar length. In an embodiment, at least one of the support walls 220 can include a substantially planar surface. It is contemplated that the support wall is to present a slightly convex or concave profile, by having some small outward bow or curvature (as can be seen with reference to FIG. 2B), and would be within the meaning of the term "substantially planar". In one embodiment, two support walls 220 disposed on opposite sides of the base 210 can include substantially planar surfaces, respectively, while two other support walls 220 disposed on opposite sides of the base 210, each of which is substantially perpendicular to the two substantially planar support walls 220, can include non-entirely planar surfaces, respectively. In another embodiment, one or more of the plurality of the support walls 220 includes a surface having features that provide additional rigidity and/or strength to the support wall, such as incorporating one or more of ribs, columnar grooves, flutings, vertical channels or corrugations, as can be seen in FIGS. 1A, C. and E, for example.

In an exemplary embodiment, the single-walled disposable cooler 100 is prepared from a uniform layer of fiber material, which may be paper or other fibrous material. In an embodiment, the fiber material is originally a pulp slurry using pre- and post-consumer newsprint, kraft paper, and other selected waste papers which are fed into a pulping machine and mixed with water. The recycled paper is reduced to small pieces and then further defibered into a homogenized slurry of paper and water. In other embodiments, other fibers can also be utilized. During defibering, dry fibers, pulp sheets or paper are added with water and continuously agitated such that the dry pulp sheets or clean recycle paper sheets are broken down and separated into fibers, that is, to separate all of the fibers. Other additives may also be combined with the slurry, including waxes or sizing agents and/or binders to ensure proper binding of all the pulp and additives. It is also possible to use other fibrous materials. However, by using 100% pre- and post-consumer newsprint, kraft paper and other selected waste papers, as the source for wood pulp, the cooler 100 remains economical and environmentally friendly.

Figure 1E:
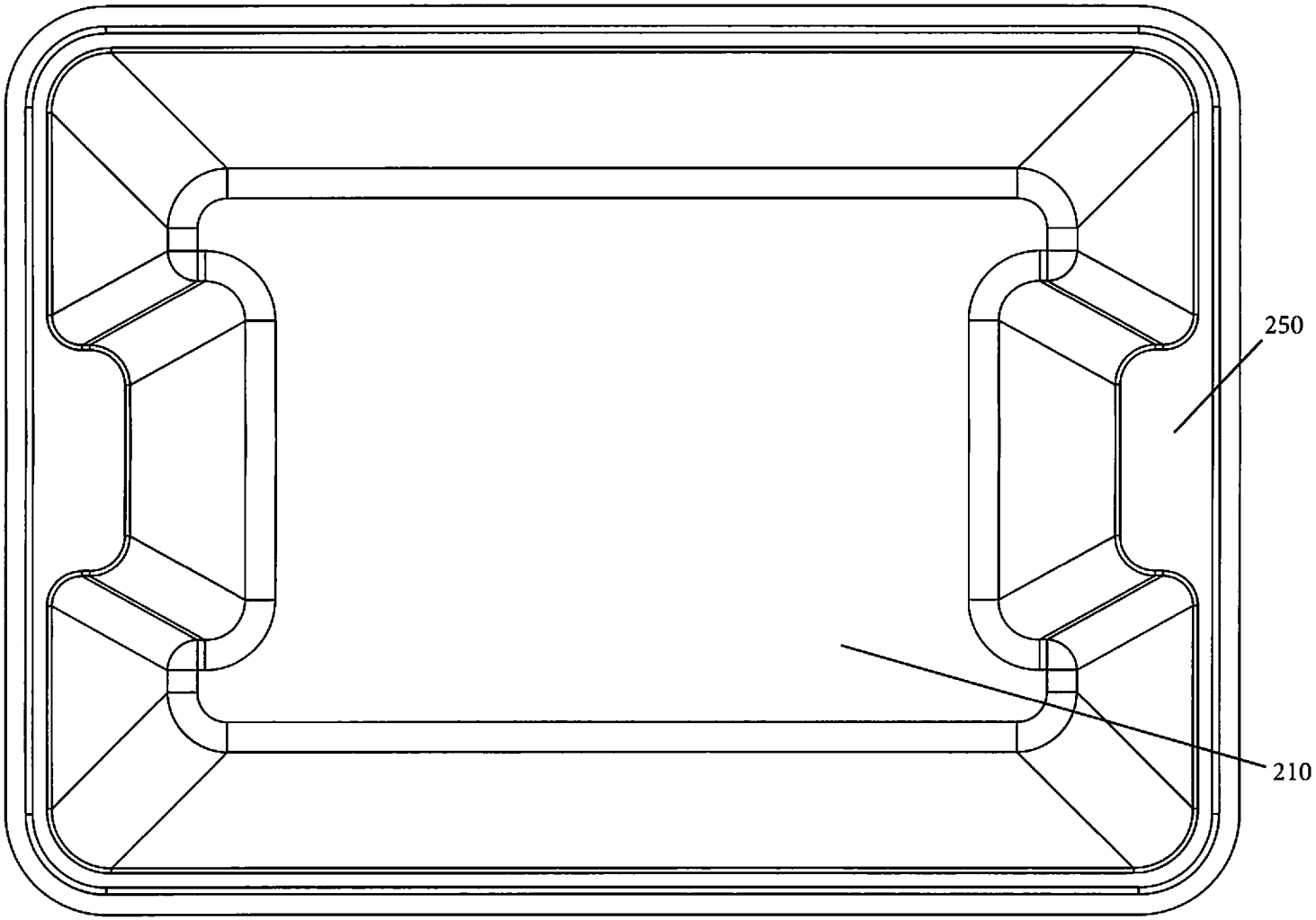
FIG. 1E is a top view of a body for the single-walled disposable cooler of FIG. 1A, shown without the lid therewith.
Figure 1F:
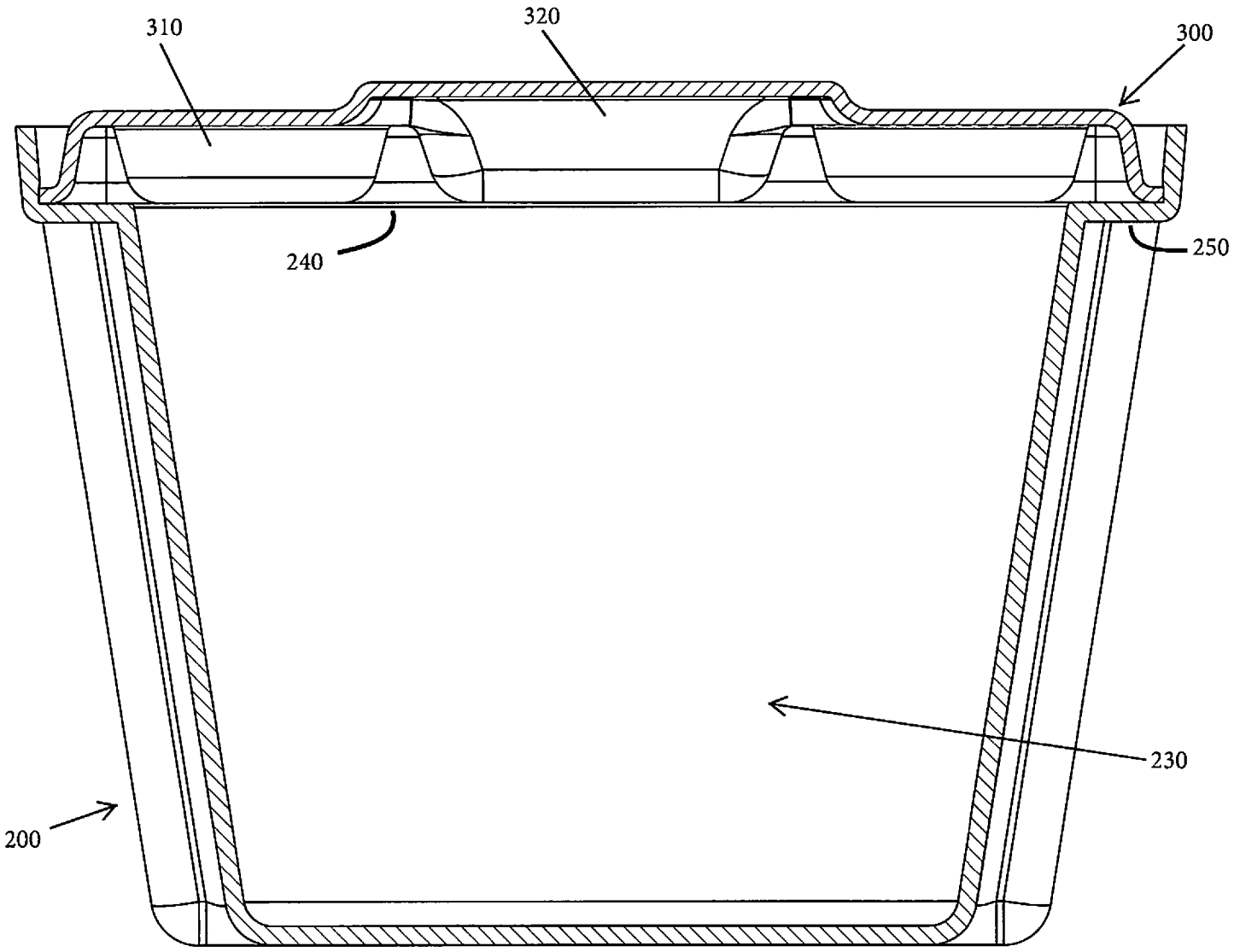
FIG. 1F is a sectional view of the single-walled disposable cooler of FIG. 1A.
Figure 2A:
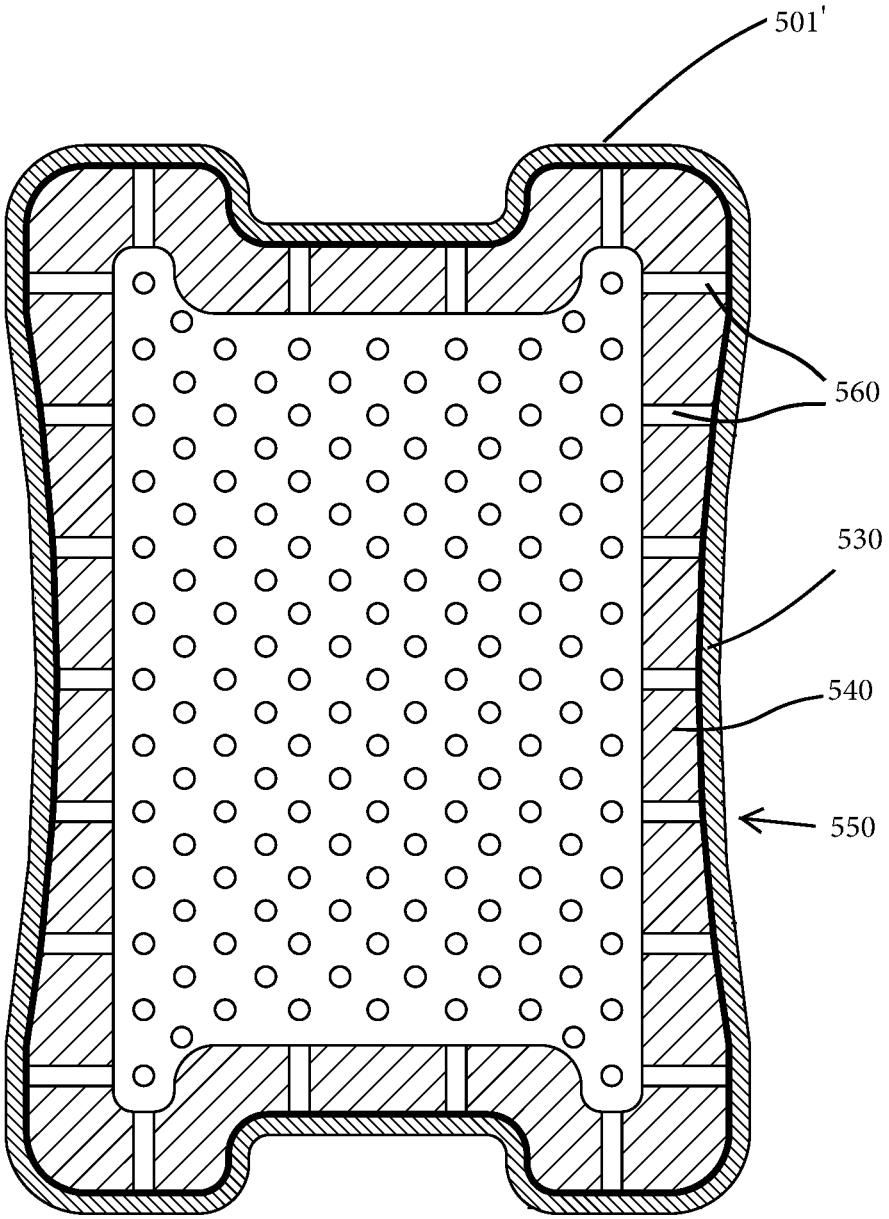
FIG. 2A is a sectional top view of a single-walled disposable cooler forming to a forming die according to the invention.
Figure 2B:
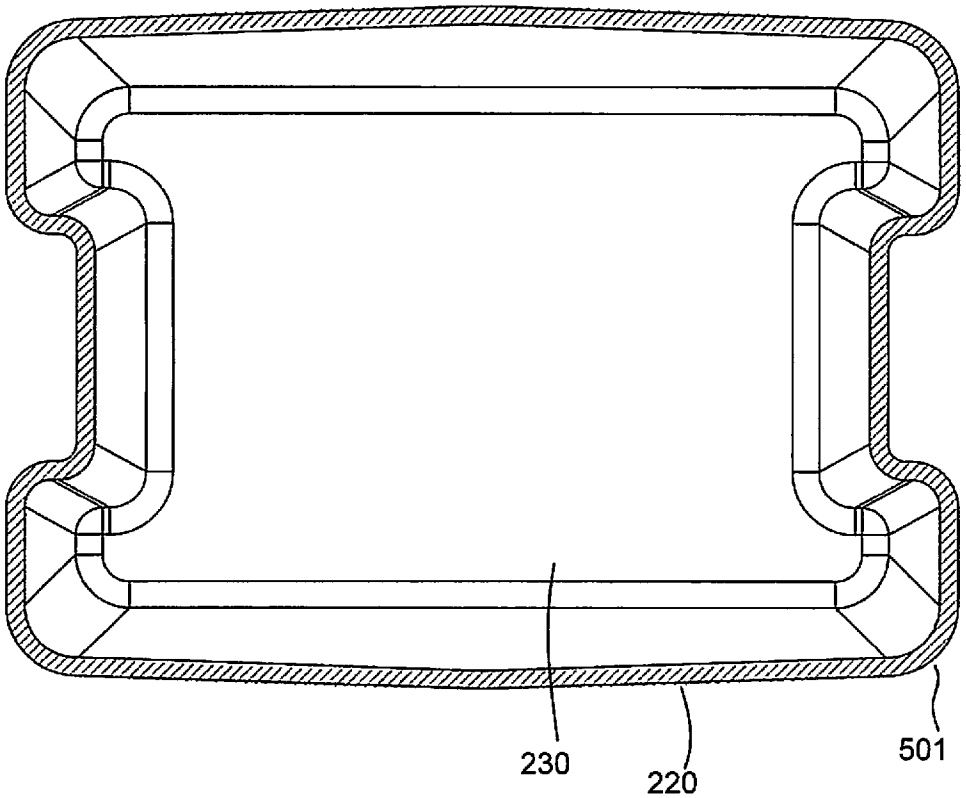
FIG. 2B is a sectional top view of the single-walled disposable cooler of FIG. 2A shown after release from the forming die.
Figure 3A:
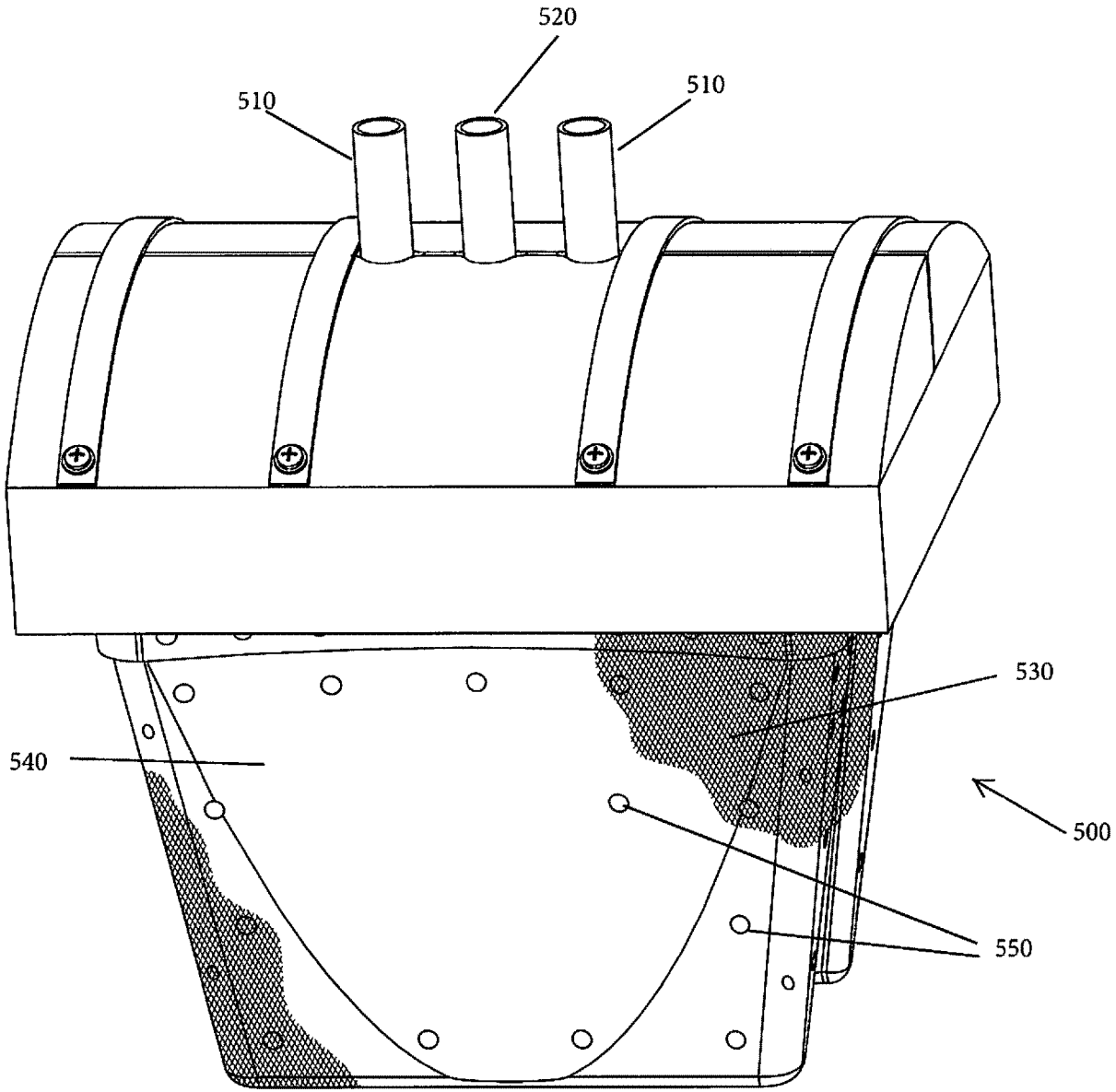
FIG. 3A is a perspective view of a forming die for a single-walled disposable cooler according to an exemplary embodiment of the invention.
Figure 3B:
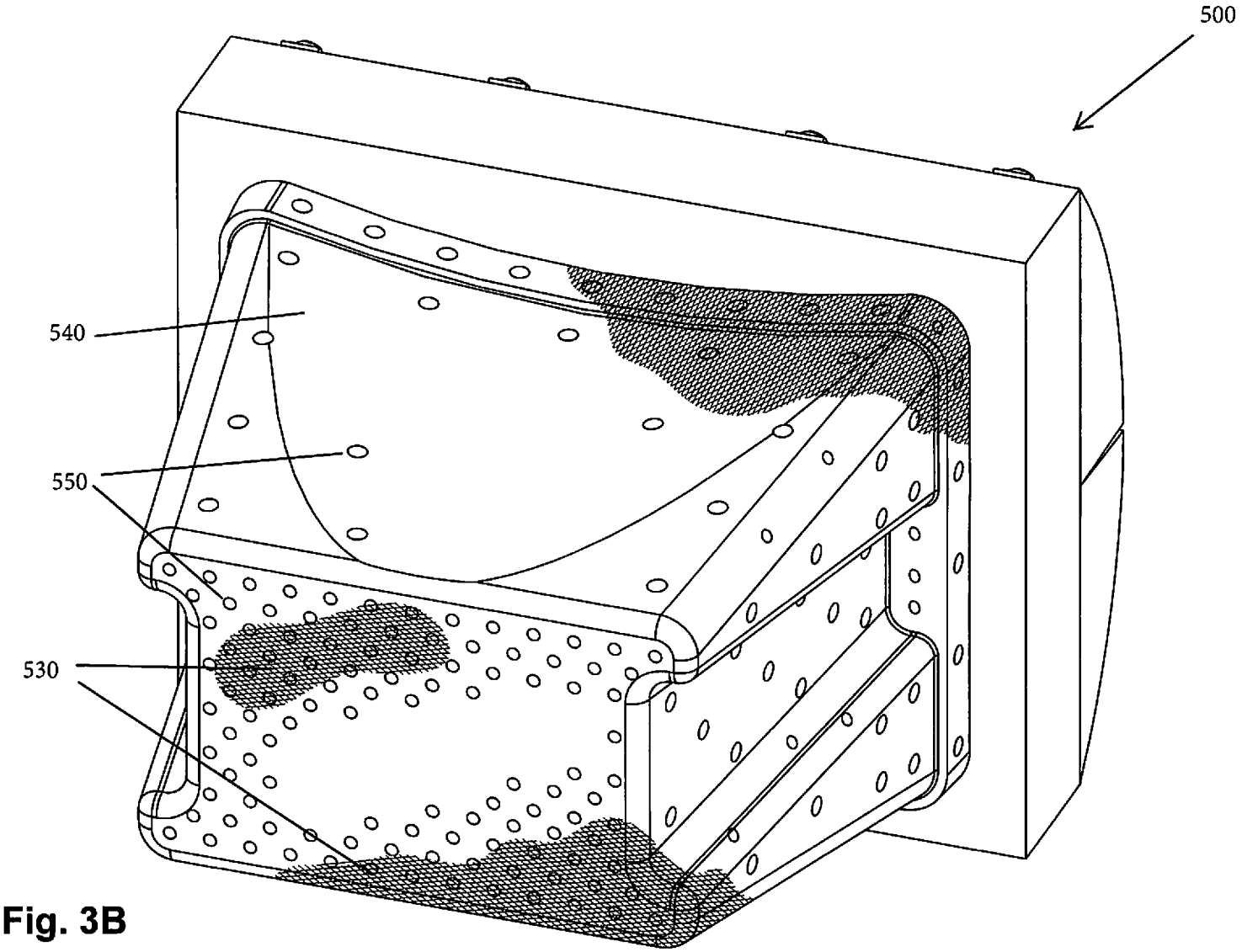
FIG. 3B is another perspective view of the forming die of FIG. 3A.
Figure 3C:
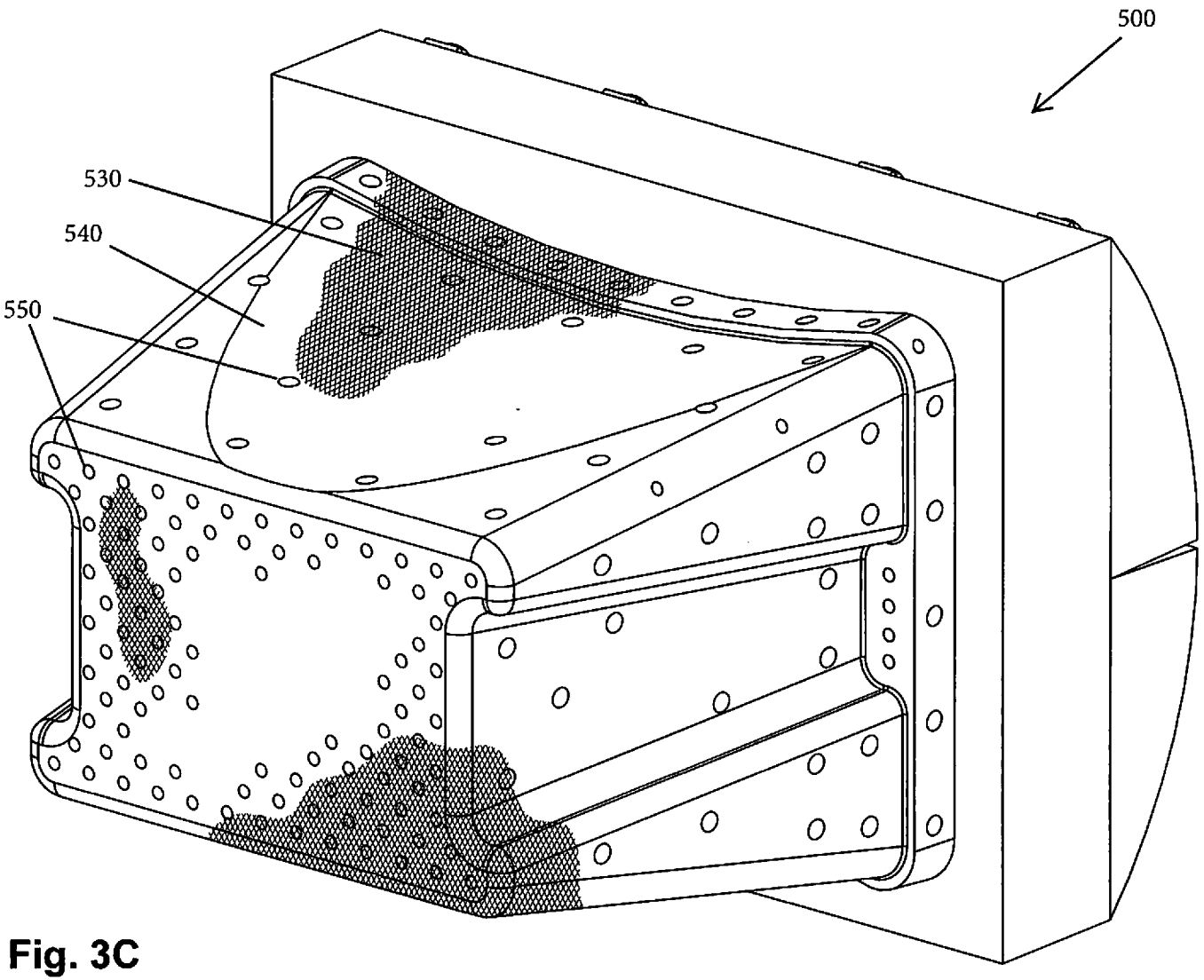
FIG. 3C is yet another perspective view of the forming die of FIG. 3A.

The support walls 220 and the base 210 can define an interior cavity 230 of the body 200, as can be seen with reference to FIGS. 1E, 1F, and 2B. The support walls 220 can extend upwardly from the base 210 to form an opening 240 at an upper terminus of the body 200. The opening 240 can be in fluid communication with the interior cavity 230 of the body 200. Notably, forming at least one of the support walls 220 with a substantially planar surface, and having a slightly convex profile (i.e., minimally bowed out surface) will beneficially increase the volume of the interior cavity 230, allowing for greater storage capacity in the cooler 100. In an embodiment, the cooler 100 would be sized so as to be able to contain at least a standard size 6-pack of 12 ounce cans or bottled beverages, along with ice or other cooling source to keep the contents chilled for several hours. In another embodiment, the cooler 100 would be sized to contain at least 12, at least 18, at least 20, at least 24, standard 12 ounce cans, along with ice or other cooling source. In an embodiment, the interior cavity 230 is at least 4 quarts, at least 7 quarts, at least 16 quarts.

The cooler 100 is formed from a dried slurry, and provides a smooth or rough interior surface formed where the pulp was in contact with a mold. The shape and roughness is dependent and results from the molding process, which is described in more detail below. For instance, the mold of a male mold will have a rough outer surface, while a female mold will produce a smooth outer surface. The thickness of the base 210 and support walls 220 are controlled by the molding process.

The body 200 can be formed to include various features. For instance, the body 200 can be formed with one or more handle portions 320 disposed at an upper region of the body 200. In one example, the support walls 220 can be formed with a ledge 250 disposed beneath the upper ends of the support walls 220. The ledge 250 can be substantially parallel with the base 210. The ledge 250 can therefore function as a handle portion 320 on the body 200 of the cooler 100, where a user grips an exterior portion of the ledge 250 for transport of the cooler 100. Specifically, the user can wrap his or her fingers under the inwardly extending portion of the ledge 250, as can be seen, for example, with reference to FIG. 1B. Moreover, central portions of the support walls 220 can be formed with indentations so as to produce additional room under the ledge 250 for an improved grip as can be seen, for example, with reference to FIG. 1C, depicting an end view of the cooler 100 having the indentation, and FIG. 1E, where the top view of the interior of the cooler 100 with the upper surface on the interior of the ledge 250 provides an indication of the size of the enlarged handle portion 320 that would be created on the corresponding underside of the ledge 250, such that the user may grip underneath the ledge 250, within the indentation region 330, and against the exterior of the cooler 100 in order to lift and transport the cooler 100.

The cooler 100 can further include a lid 300, for example, as depicted in FIGS. 1A, 1D and 1F, capable of covering the opening 240 of the body 200. In this regard, the lid 300 can be configured to reversibly couple with the body 200 of the cooler 100 in any of a variety of ways, some of which are described herein. The lid 300 can be shaped in conformity with the opening 240 of the body 200, and form a friction fit therein, so as to reversibly secure the lid 300 within the opening 240, and create an effective seal between the lid 300 and body 200, as the lid 300 seals within the opening 240.

The lid 300 can be formed to include various features. For instance, the lid 300 can be formed with one or more cup holders 310 disposed on a top portion thereof, as depicted in FIGS. 1A and 1D. The one or more cup holders 310 can be formed into the top portion of the lid 300 in any suitable configuration. Characteristics such as the dimensions, positioning, and number of the one or more cup holders 310 can vary. In addition, one or more lid handle portions 320 can be formed into the lid 300, as discussed in greater detail below. In an embodiment, as depicted in FIG. 1D, there is provided a lid 300 having four cup holders 310, generally located near each corner of the lid 300, and a centrally located handle portion 320, configured for being grasped by the user, with indentation regions 330 on either side of the handle, to accommodate the user's fingers. It is contemplated that less or more cup holders 310 and or handles may easily be produced. For example, it is contemplated that the lid 300 may provide a pair of handles nearing opposing ends of the lid 300, and centrally locating one or more cup holders 310 in the central portion of the lid 300. Alternatively, one or more handles may be provided as pull tab incorporated into the lid 300 near or adjoining one or more of the edges of the lid 300. In an embodiment where the handle is in the form of a pull tab, it may be connected to the lid 300 edge by a living hinge. It is contemplated that the pull tab may protrude from the edge, such that when the lid 300 is in place within the opening 240, the pull tab is deflected upwards by the body 200, in a direction away from the base 210, by flexing at the living hinge. The pull tab would remain accessible for the user to grasp and pull, enabling the user to easily remove at least that edge of the lid 300 having the pull tab, and lifting the lid 300 or portion of the lid 300 from the opening.

In an exemplary embodiment, the lid 300 may have molded features, for example, cup holders 310 or handles. These molded features, in addition to their stated function, may beneficially increase the overall rigidity of the lid 300, as the addition of structural grooves, ribs or designs into an otherwise flat surface will greatly increase the strength, as the moldings have the effect of transforming a two-dimensional sheet structure into a three-dimensional structure. Similarly, the incorporation of ribs, columnar grooves, flutings, gussets, vertical channels or corrugations in the sidewall of the body 200 of the cooler 100 will provided structural reinforcement as well.

Notably, the body 200 and the lid 300 of the cooler 100 can be made entirely of a pulp-based material or fiber-based material. Alternatively, the body 200 can be made entirely of a pulp-based material, and the lid 300 can be made of a non-pulp-based material.

Pulp, as is generally known in the art, is a fibrous material prepared by chemically or mechanically separating cellulose fibers from wood, recycled paper, straw, grass, hemp or other raw fibrous materials. Pulp is understood to be more eco-friendly than polystyrene, as pulp can be biodegradable (i.e., capable of disintegrating into an innocuous material), recyclable (i.e., capable of being reused or treated for reuse), and/or compostable (i.e., capable of decomposing within 90-180 days), without release of toxic residues upon decomposition.

In some cases, the pulp-based material from which the cooler 100 is made can be derived entirely from pre-consumer or post-consumer recycled paper. In other cases, the pulp-based material from which the cooler 100 is made can be derived from a combination of the recycled paper and a wax additive (e.g., paraffin wax) added to enhance the water resistance of the cooler 100. The pulp-based material or fiber-based material can alternatively be treated to have enhanced hydrophobic properties that will allow the pulp material to better repel water penetration. Such enhanced hydrophobicity may be through the incorporation of a wax, as described above, or alternatively by incorporating any of the known biodegradable and hydrophobic plastics (such as polylactic acid (PLA) or polygycolic acid (PGA)). These hydrophobic additives, such as wax or resorbable polymers, may be incorporated within the slurry, as the additives can have melting points that are low enough to melt when the molded product is dried in an oven, and may melt flow during the drying stage to coat the fibers; or in another embodiment. Alternatively, hydrophobic properties or water impermeability may be achieved by providing resorbable polymers, for example PLA or PGA, that may be applied as a thin surface coating to the dried molded product, the coating forming a water impermeable barrier, at least on an inside surface of the cooler 100. Alternatively, incorporating a hydrophobic component, such as resin or any other additive as known to those skilled in the art, which may be coated onto, or impregnated throughout the pulp molded component. Any hydrophobic treatment should not negatively impact the ability of the pulp molded product to be composted, recycled or biodegraded, and further, should be compatible with the use of the pulp molded product as a temporary storage container for food stuffs and beverages. In yet other cases, a small amount of rosin (a solid form of resin) can be added to the pulp-based material or fiber-based material to enhance the cooler 100's durability. It is understood, however, that the pulp-based material can derive from any suitable pulp-producing materials generally known in the art.

Referring now to FIGS. 3A-C, the apparatus for molding the body 200 from a fibrous slurry is shown having a forming die 500. The forming die 500 being made up of a die body 540, a screen 530 and a vacuum mechanism 510, and a pressure mechanism 520. The die body 540 having a plurality of perforations 550 in fluid communication with a plurality of channels 560 extending there through, and selectively in fluid communication with a source of negative pressure through the vacuum mechanism 510. The channels 560 (shown in FIG. 2A) extending through the die body 540 are also selectively in fluid communication with a source of positive pressure through the pressure mechanism 520. Each of the vacuum mechanism 510 and pressure mechanism 520 may be a pipe connected to a pressure source (positive or negative, as appropriate), and may optionally include one or more valves to isolate the forming die 500 from the positive or negative pressure source, as needed during the manufacturing process. Alternatively, the pressure (negative or positive) may be controlled away the forming die 500, such as through a valve in-line between the vacuum or pressure sources and the forming die 500. The control of the positive and/or negative pressure sources may be automatically controlled, or manually controlled, and use valving to selectively deliver positive or negative pressure (as appropriate) to the interior of the forming die 500, where the valves may be manually operated valves, or remotely controlled valves.

The die body 540 may be formed from any material having the characteristics of being porous or otherwise provided with a plurality of channels 560 for the passage of fluids there through. The material must also be sufficiently rigid to withstand the required positive and negative pressures in the manufacturing process, and easily shaped to permit the molding surfaces of the die body 540, contrary to the accepted practice, to be constructed either by hand using simple hand-held cutting tools, or by machine using relatively simple manual tools, or automatically using computer controlled cutting tools. Accordingly, the die body 540 of the invention may be manufactured with significantly less time and cost than conventional forming dies which require relatively labor intensive, time consuming, and expensive molding, machining and drilling, or electroforming operations. Further, it should now be apparent that the use of materials having the above-described characteristics permits the die body 540 of the invention to be easily and inexpensively modified to allow for formed articles to be manufactured incorporating various design changes.

The die body 540 is provided with a plurality of internal channels 560, and thus acts as a manifold, where the channels 560 within the die body 540 are configured to distribute the vacuum from the vacuum mechanism 510 that is derived from any source of negative pressure (not shown), over at least the area of the die body 540 that corresponds to the shape to be formed, referred to as the molding surface. Additionally, the channels 560 in the die body 540 are configured to distribute compressed air or other pressurized gases from the pressure mechanism 520, as will be discussed below.

At least the portion of the exterior of the die body 540 that is the molding surface is covered with a fine mesh screen 530 that conforms to the shape of the die body 540, and provides a smooth inner surface to the interior of the cooler 100 components (body 200 and lid 300). The screen 530 upon the die body 540 serves as a negative form of all the internal aspects of the molded fiber layer 501', as the outside surface of the screen 530 will be in contact with the inside surface of the molded layer of fibers. Thus the screen 530 provides all the surface features that would appear in the pulp molded layer, and it is therefore desirable that the screen 530 be a smooth molding surface, free of wrinkles or blemishes that would otherwise mar the smooth interior surface of the cooler 100 components. In use, the screen 530 prevents the passage of fiber material of the pulp slurry as it is drawn by vacuum towards the forming die 500, but allows the water from the slurry mixture to pass through the screen 530, where the liquid can be drawn into the perforations 550 when sucked by the vacuum mechanism 510. As the screen 530 prevents the fiber material from also being sucked through the perforations, the fibers will amass against the perimeter of the screen 530, and build up to form a matted layer upon the screen 530, by the continued application of vacuum when the forming die 500 is directed into the slurry. The screen 530 must be strong enough to resist deforming significantly under the negative pressure as the molded layer of fibrous material builds up on the outside surface of the screen 530. In an embodiment, the screen 530 may be formed from metal mesh, though it is contemplated that other materials and forms may be utilized instead, as will be understood by those skilled in the art. For example, a plastic mesh may also be utilized in addition to, or in place of a metal mesh. The screen 530, the perforations 550, and the vacuum mechanism 510 allow the fiber material to mold to the exterior portion of the forming die 500 surface, and then continued vacuum would remove enough water from the fiber material to allow the molded fibers to self-support itself once it is removed from the forming die 500. The term "self-supporting" is intended to mean there is no significant change in overall shape or form of the material attributable solely to the force of gravity acting upon the material alone; for example, where a sample molded component is placed onto a flat surface, the sample would not display a tendency to sag or collapse in any portion or dimension of the sample. A material that is "self-supporting" is not intended to exclude the movement or shifting of portions of the sample when subjected to additional forces beyond the force of gravity.

The forming die 500 is provided with a pressure mechanism 520 to facilitate removal of the molded layer that makes up the respective cooler 100 components (body 200 and lid 300). Removal of the molded fibers can be accomplished by closing off the vacuum mechanism 510, and optionally allowing the negative pressures in the die body 540 to equalize. The vacuum should be turned off only after the molded fibers have been dewatered to the point at which the molded fiber layer 501' (shown in FIG. 2A) would be self-supporting, which occurs when sufficient water has been drawn out of the matted fiber layer that the fibers are not loosely matted, and unable to easily move or slide relative to each other to the point where gravity would alter the shape, but in any event before the fiber layer has dried, and the fibers are locked against each other. Once the fiber layer has been dewatered to the point it would be self-supporting, the pressure mechanism 520 may be actuated or otherwise allow the delivery of a charge of pressurized air, or other gaseous fluid, through the pressure mechanism 520 into the die body 540, where the channels 560 are configured to distribute the pressurized charge through the perforations 550, and against the inside surface of the molded fiber layer 501', as will be discussed below. The elevated pressure from within the forming die 500, acts upon the molded layer to expand at least a portion of the molded layer, such that there is a shape change from the initial molded state, and thereby facilitates removal of the molded layer from the forming die 500 while the molded layer is in a second state.

The process for manufacturing the single-walled cooler 100 made of a pulp-based material or fiber-based material will be described with more particularity below.

The forming of a pulp-based material for the cooler 100 components described herein can be performed by preparing a fibrous slurry with wood-based fibers suspended in an agitated suspension fluid, such as water. The suspension fluid as it is agitated, may optionally be subjected to heating, so as facilitate the separation of the pulp material into fibers, and optionally cause swelling of the fibers. The fibrous slurry may be prepared using, for example, pre- and post-consumer newsprint, kraft paper, and other fibers and selected waste papers which are fed into a pulping machine and mixed with water. It is also contemplated that virgin wood pulp fibers would similarly be capable of being processed according to the teachings herein, by simply being substituted like-for-like with the recycled paper to serve as the wood pulp source for processing as taught herein. In preparing the fibrous slurry, recycled paper is reduced to small pieces and then further defibered into a homogenized slurry of paper and water. During defibering, dry pulp sheets or paper are added with water and continuously agitated such that the dry pulp sheets or clean recycle paper sheets are broken down and separated into fibers, that is, to separate all of the fibers. In an embodiment, the slurry is prepared at a ratio pulp:water, where the pulp is present within a lower range of at least 0.5% pulp fibers, at least 0.75% pulp fibers, at least 1% pulp fibers, at least 1.5% pulp fibers; and an upper range of less than 2% pulp fibers, less than 1.5% pulp fibers, less than 1% pulp fibers, with the balance being water, and optionally additives. In an embodiment, the slurry comprising pulp fibers, water and additives is adjusted by the addition of water or additives to achieve a preferred ratio of about 1% pulp fibers, and of about 99% water and optional additives. Where the additives are to be distributed throughout the entire volume of the molded product, the additives may be incorporated into the slurry as it is agitated, to provide desirable characteristics to the entirety of the end product as the additives properties would be distributed homogenously throughout the fiber matrix to impart the beneficial property of the additive, for example, water impermeability, or increased strength and rigidity to the formed article.

According to the method of producing the cooler 100 components from a fibrous slurry of the invention, a forming die 500 comprising a water insoluble, porous (i.e., screen 530 and perforations 550), and relatively rigid and easily shaped material is provided, having a surface that serves as a negative form for the molded components (i.e., body 200 and/or lid 300) that collectively form the cooler 100. The forming die 500 is then disposed into a vat having an agitated fibrous slurry. The vacuum mechanism 510, provides vacuum from a source of negative pressure to draw the fibrous slurry against the screen 530 and take on the form of the molding surface of the forming die 500, as the fibers drawn towards the screen 530 amass and mat together to form a substantially uniform layer of fibrous material. The slurry water is drawn by the negative pressure through the openings in the screen 530, then through the perforations 550 in the die body 540, drawn into the forming die 500 and channeled to the vacuum mechanism 510. Continued application of vacuum draws more of the slurry towards the forming die 500, after sufficient water has been drawn to obtain the required thickness of the fiber layer, the die 110 may be removed from the slurry. The vacuum pressure and duration necessary for drawing the fibrous slurry against the molding surfaces of the forming die 500 may be readily determined by one of ordinary skill in the art and will depend on various process conditions such as the composition and viscosity of the slurry, the temperature of the slurry, and the configuration and wall thickness of the article to be produced.

The thickness and physical characteristics of the fiber layer formed can be affected by controlling or varying manufacturing conditions as would be understood by those skilled in the art, including aspects such as, for example, the amount of negative pressure applied, the duration during which the forming die 500 is within the slurry, the duration of vacuum application, the ramp-up rate or ramp-down rate of the application of negative pressure, the slurry temperature, viscosity and density, the average fiber length, and fiber length distribution, and source of wood fiber (e.g., hardwoods, softwoods, fiber crops).

In one embodiment, when a fibrous layer has been deposited at the desired thickness, the forming die 500 is removed from the slurry. After a period of time out of the slurry, the vacuum mechanism 510 may be actuated so as to remove the negative pressure and allow the negative pressure within the die body 540 to equalize to near ambient pressure. This may be accomplished by closure of a valve delivering the negative pressure, where the vacuum mechanism 510 is a valve. The vacuum should be stopped at the point at which the molded layer would be self-supporting, were it removed from the mold, but before the molded layer is dried to the point where the fibers of the molded layer would so locked together as to prohibit some shaping of the molded layer. After the molded layer has dried sufficiently to the point of being self-supporting, it may be removed from the die 110 by hand or mechanically with the actuation of the pressure mechanism 520, to deliver a charge of pressurized air or other gaseous fluid through the die body 540, via channels 560 and out the perforations 550, where the elevated pressure will serve to push at least a portion of the molded layer away from the forming die 500, as will be discussed below. In order to quickly reduce the moisture content of the molded layer after removal from the forming die 500, the molded layer may be placed into a conventional oven having a temperature of less than about 500 degrees. Additionally, the exposure to heat may beneficially act upon, or otherwise activate one or more of the additives that were in the slurry, and are now incorporated into the thickness of the material. The amount of time and the particular heating temperature may be readily determined by one of ordinary skill in the art.

In an embodiment, and with reference to FIG. 3B, the forming die 500 is provided with a small amount of inward curvature or taper on the longer sidewall surfaces, generally having a slightly concave profile (as depicted in FIG. 2A). Given the dimensions of forming die 500 and the large surface area which will be covered by the molded layer, the incorporation of these tapered surfaces in the forming die 500 greatly facilitates the removal of the molded layer from the forming die 500. In this embodiment, as the forming die 500 is removed from the slurry, and subjected to dewatering outside of the slurry by continued application of negative pressure, the resulting wet molded layer will conform to the outside surface of the forming die 500 against the screen 530, and thus, the molded layer initially conforms to, and presents the concave inward curvature dictated by the die 110, as best seen with reference to FIG. 2A, depicting a top view of a cross-section through a horizontal plane at approximately half-height of the forming die 500. After removal of the forming die 500 from the slurry, and after removing enough water from the molded layer that it would be self-supporting, the vacuum is removed and internal pressure allowed to equalize. Before the molded layer has dried completely, a charge of high pressure air, or compressed gas, is introduced through the forming die 500 via the pressure mechanism 520. The sudden increase of pressure internal to the wet molded layer acts upon the inward curvature of the longer sidewall of the wet molded layer and causes those sidewall elements to be pushed out, and form a slightly bowed out sidewall, such that the sidewall is converted from having a first state that presents a slightly concave profile (as represented by the molded fiber layer 501' with reference to FIG. 2A), to a second state that presents a slightly convex profile (as represented by the molded layer 501 with reference to FIG. 2B). The outward bow of the sidewall is not so significant that the sidewall would not be considered substantially planar. As the major (e.g. longer) sidewalls or support walls 220 of the molding layer are expanded, and released from the forming die 500, there becomes significantly less surface area inside the molded layer remaining in contact with the screen 530 that would otherwise be retaining the molded layer onto the forming die 500. The continued application of pressurized air will increase the pressure inside the molded layer above ambient pressure, to the point that the elevated air pressure causes the molded layer to be completely released from the forming die 500. The air pressure delivered is preferably not so great as to distort other portions of the molded layer, other than the expansion of the concave, inwardly curved sidewall portion to the convex, outwardly curved sidewall, as can be seen by comparing sidewall profiles in FIG. 2A to 2B. The wet molded layer, now freed from the mold, and still self-supporting, may then be subjected to drying, typically through exposure to heat that will drive off the retained moisture within the molded layer to form the dry molded product. Notably, the removal of the moisture will promote fiber to fiber bonding that will lock the fibers making up the component into a three-dimensional interlocked matrix. Due to the dried nature of the wood pulp fiber matrix, the dry molded product will be strong, resilient and lightweight. Additionally, the plurality of support walls 220 of the body 200, as they are formed having the slightly convex profile, due to the bow outwards from a planar surface, will provide greater strength to the final form than would a strictly planar surface, as even a simple curve would be structurally stronger than a flat sheet of a similar material. Additionally, the slight bow out of the sidewall results in a larger volume within the body 200 of the container than would occur with a planar sidewall, or the concave initial form when conformed to the die 110 form. The incorporation of the ledge 250, and upper boundaries of the body 200, and the vertical ribs or gussets in the sidewall (for example, as visible in the short sidewall depicted in FIG. 1C) are all components that beneficially provide enhanced structural reinforcement to the dry molded product forming an embodiment of the body 200. Similarly, with the lid 300 component, molded features, for example, the handle portions 320, cup holders 310, and outer ridge portion of the lid 300, provide enhanced structural integrity to the lid 300 as these molded features lend a depth dimension to what would otherwise be a planar two dimensional sheet.

While the die 110 components for forming the lid 300 from a pulp-based material is not depicted, one skilled in the art would readily understand how to adapt the teachings for the production of the body 200 component, to produce the lid 300 component. In the manufacture of the lid 300 component, a forming die 500 would be provided, where the forming die 500 is shaped to serve as the negative form of the interior surface of the exemplary embodiment of the lid 300 taught herein. As with the previously described forming die 500 for the body 200 component, there would be provided a die body 540, a screen 530, and a vacuum mechanism 510, and optionally a pressure mechanism 520. The die body 540 would have channels 560 extending there through and in fluid communication with the vacuum mechanism 510, and optionally pressure mechanism 520. The screen 530 would conform to the die body 540, and as before, would prevent the fibers from passing through the screen 530 upon the application of vacuum through the die body 540, drawing the slurry towards the forming die 500. The slurry liquid passes through the screen 530, and enters the die body 540 through perforations in the die body 540 that lead to the channels 560. Once adequate thickness of the molded layer for the lid 300 component is matted against the screen 530, the die 110 may be removed from the slurry. The vacuum may be removed from the die body 540 once the lid 300 molded component has been dewatered to the point it would be self-supporting. The lid 300 may then be removed from the mold by hand, or alternatively, by the use of pressurized air or gasses through the pressure mechanism 520. The lid 300 component may then be subjected to drying, as described with the body 200 component.

The drying of the wet molded product (body 200 or lid 300) is performed at a temperature that will drive the moisture out of the molded article, and may also beneficially, cause the additives incorporated into the slurry to melt and coat the fibers that form the molded component. In an embodiment, the temperature for drying the wet molded product is less than 500 degrees Fahrenheit, and greater than room temperature. For example, where paraffin wax is incorporated into the slurry, the heat of drying the molded component, whether lid 300 or body 200, will melt the wax, and be distributed throughout the fibers. Once cooled, the wax would solidify as a hydrophobic coating extending through the matrix of the fibers. It is contemplated that a resorbable polymer having a melting point below the drying temperature may behave similarly. Alternatively, post drying treatments may be applied to the molded articles, such as applying a thin coating of a plastic, such as PLA or PGA to the interior surface of the cooler 100 to provide an impermeable barrier layer to the inner surface of the cooler 100 components. By using resorbable plastics, such as PLA or PGA for this application, the cooler 100 would remain biodegradable, compostable, or recyclable.

Each of the body 200 and/or lid 300 components that are usefully combined to form a cooler 100, may be have an overall shape and form such that the individual components (e.g., body 200, lid 300) are capable of nesting inside like components for efficient storage and transport. In such an embodiment, one, or both of the body 200 and lid 300 may be tapered in the vertical direction (e.g., narrowed at the base 210 or bottom, and slightly increasing in a width dimension away from the base 210 for a tapered body 200 component), such that multiple bodies may be stacked, one within the other. The lids, similarly may be capable of nesting one with another. Preferably, the amount of one component nesting within the other is, as a percentage of the overall height of the component, in the range of from a lower range of at least about 50%, at least about 65%, at least about 75%, at least about 80%, at least about 85%, at least 90% to an upper range of less than about 95%, less than about 90%, less than about 85%, less than about 80%, less than about 70%. The nature of the pulp mold manufacturing presenting a smooth inside surface, and a rough outside surface, or the reverse (i.e. female mold) and thereby provides for easier separation of the nested components for use, as the rough side (on the outer surface of the body 200) when placed directly against the smooth interior of the body 200 it is nested in, allows air passage and equalization of the air pressure within the nested components, relative to ambient air pressure, as the rough surface against the smooth surface maintains small gaps and passages between the adjoining surface through which air can pass, thereby preventing the formation of negative pressure (e.g., vacuum) inside the nested components that would otherwise prevent the separation of the nested components. Furthermore, by presenting a rough surface have protruding surface irregularities, against a smooth interior surface, this will limit the extent of the surface area of the nested components in direct contact with each other, thereby minimizing frictional forces from preventing separation of the nested components, as would otherwise occur with 2 smooth surfaces against each other. Additionally, it is contemplated that the components may be formed with ribs or gaps on at least one surface that interfere with the insertion of one component at a desired percentage of insertion, and in this manner the molded features may further serve to prevent nested components from being stuck together too tightly. One skilled in the art should appreciate, a female mold design could be used in a similar manner, but provides for a smooth outer surface that facilitates printing and embossment.

It may be useful to apply a label to the product, for example, where the product is to be available for commercial sale. The label may be applied using various techniques known in the art, for example, using a label and adhesive to affix the label to a portion of the cooler 100 product. In an embodiment, the information to be included on the label could be imprinted onto the surface of the cooler 100, using, for example, inks, paints or dyes, in combination with stencil, or screen 530 printing techniques. Alternatively, laser engraving, or marking with a brand iron could apply the labelling information in a visible manner directly into the product material.

The dried wood pulp components formed by the manufacturing process described form an interlocked matrix of wood fibers, where the matrix has significant porosity retained within the dried fiber matrix. As such, the components produced according to the teachings herein thus provide toughness and resilience to the structure, and as wood is a poor conductor, when combined with the significant porosity provides a strong container with good insulating properties, so as to be functional as a cooler 100 to maintain articles below ambient temperature for several hours, when combined with cooling source, such as ice.

The features and aspects of the shown exemplary embodiment depicted in the figures will be discussed below.

Referring now to FIGS. 1A-1F, the lid 300 can be formed so as to fit inside of the upper ends of the plurality of support walls 220 according to an exemplary embodiment of the present disclosure. Ideally, the lid 300 is sized such that it creates a friction-fit into the body 200 to rest against the top of the ledge 250, inside the body 200, thereby creating a form fitting seal. The friction fit of the lid 300 within the body 200, resting atop the ledge 250 will minimize the air gap that may occur between the container interior and the outside ambient air, in order to provide better insulative properties to the cooler 100. FIG. 1A illustrates a perspective view of the cooler 100 according to the exemplary embodiment of the present disclosure; FIG. 1B illustrates a front view of the cooler 100 according to the exemplary embodiment of the present disclosure;

FIG. 1C illustrates a side view of the cooler 100 according to the exemplary embodiment of the present disclosure; FIG. 1D illustrates a top view of the cooler 100 according to the exemplary embodiment of the present disclosure; FIG. 1E illustrates a top view of the body 200 without the lid 300, according to the exemplary embodiment of the present disclosure; and FIG. 1F illustrates a cross-sectional front view of the cooler 100 100, with the lid 300 in place, resting on the ledge 250, to seal the cooler 100, according to the exemplary embodiment of the present disclosure.

As shown in FIGS. 1A-1F, the support walls 220 can be formed with a ledge 250 disposed beneath the upper ends of the support walls 220. The ledge 250 can be formed so as to be substantially parallel with the base 210, as described above. The lid 300 can be formed such that outer edges thereof rest on an interior surface of the ledge 250 when the lid 300 covers the opening 240 of the body 200. Furthermore, the lid 300, as it is inserted into the top portion of the body 200, creates a friction fit with the interior of the body 200, so secure the lid 300 in place, on top of the ledge 250 and prevent the lid 300 from being dislodged accidentally.

In addition, the lid 300 can be formed with a handle portion 320 disposed at a central region thereof. The handle portion 320 can enable a user to grip a top surface of the lid 300 in order to remove the lid 300 from the opening 240 of the body 200. The handle portion 320 can be formed in any manner suitable for a user's grip. In one example, the handle portion 320 can include a portion of the lid 300 which protrudes outwardly from an indentation region 330, as shown in FIGS. 1A-1F. In another example, the handle portion 320 can include an elongated aperture (not shown) formed into a portion of the lid 300 protruding outwardly from a top surface of the lid 300. The elongated aperture can be formed to enable a user to insert his or her fingers there through. In an embodiment, the lid 300 may be provided having one or more pull tabs integrated into the edge of the lid 300, for example, via a living hinge, though it is contemplated the pull tab or handle may be a component suitable for grasping and pulling, and affixed to the lid 300 using techniques known in the art, such as adhesives. Such an embodiment would not necessarily require the centrally placed handle portion 320, and instead that area that would otherwise be occupied by the handle could be modified to provide additional cup holders 310, a tray for loose items or food stuffs, or could present surface or embossed markings (e.g. logo, or ruler demarcations), or other features as would be known to those skilled in the art.

Accordingly, the single-walled disposable cooler 100 according to the invention described herein can be made of a pulp-based material that is compostable, recyclable, and/or biodegradable. As a result, the cooler 100 according to the invention can be disposed in an eco-friendly manner in which the cooler 100 disintegrates in a compost environment rapidly relative to conventional polystyrene coolers and without leaching toxicity into the soil. The pulp-based single-walled cooler 100 according to the invention described herein can comply with modern regulations prohibiting sale of polystyrene products, while providing consumers with a storage solution that is disposable. Moreover, the single-walled disposable cooler 100 according to the invention described herein can include convenient features such as cup holders 310, handles, and the like, and reliably retain water for several days upon adding a hydrophobic additive, such as a wax additive to the pulp-based material used to construct the cooler 100. One skilled in the art should appreciate the aforementioned process for pulp-based material could be applied to fiber-based material as well.

The foregoing description has been directed to an exemplary embodiment of the present disclosure. It will be apparent, however, that other variations and modifications may be made to the exemplary embodiment, with the attainment of some or all of their advantages. Accordingly, this description is to be taken only by way of example and not to otherwise limit the scope of the shown embodiment herein. Therefore, it is the object of the appended claims to cover all such variations and modifications as come within the true spirit and scope of the described embodiment herein.

What is claimed is:

1. An apparatus for forming a single-walled disposable cooler comprising:

a vacuum mechanism;

a die having a porous body with a plurality of channels extending there through and in fluid communication with the vacuum mechanism configured to selectively deliver a negative pressure, wherein the die includes mold elements for a base and a plurality of sidewalls, wherein at least one of the plurality of sidewalls of the die has a concave profile;

a smooth molding surface provided on an exterior surface of the die, the smooth molding surface having a screen having openings to hold a fibrous material and allow water to pass through the screen and drain from the fibrous material in response to the negative pressure via the vacuum mechanism; and a pressure mechanism in fluid communication with the plurality of channels and configured to selectively deliver positive pressure through the plurality of channels, by directing a pressure charge through the plurality of channels and against an interior surface of a molded layer covering at least a portion of the porous body, the molded layer initially being in a first state characterized by having at least one support wall that is concave in profile, the molded layer urged by the pressure charge to change to a second state characterized by the molded layer having a larger interior volume than when in the first state, and said at least one support wall has been expanded outwards to have a convex profile.

2. The apparatus of claim 1, wherein the plurality of sidewalls includes a pair of major sidewalls, and a pair of minor sidewalls, where the pair of major sidewalls oppose each other, and having a length greater than a length of the pair of minor sidewalls.

3. The apparatus of claim 2, wherein the at least one support wall includes pair of major support walls, and a pair of minor support walls, where the pair of major support walls have a length that is greater than a length of the pair of minor support walls.

4. The apparatus of claim 3, wherein the pair of major support walls have been expanded outwards to have the convex profile.

5. The apparatus of claim 4, where the pair of major support walls are substantially planar.

6. The apparatus of claim 1, wherein the exterior surface of the die serves as a negative form for the molded layer.

* * * * *